US011242749B2

(12) United States Patent
Cheng et al.

(10) Patent No.: US 11,242,749 B2
(45) Date of Patent: Feb. 8, 2022

(54) CONTROL STRUCTURE FOR RIB SPALLING OF COAL WALL WITH LARGE MINING HEIGHT BASED ON FLEXIBLE REINFORCEMENT AND CONSTRUCTION EQUIPMENT THEREFOR

(71) Applicant: North China Institute of Science and Technology, Langfang (CN)

(72) Inventors: Zhiheng Cheng, Langfang (CN); Shuaifeng Yin, Langfang (CN)

(73) Assignee: North China Institute of Science and Technology, Langfang (CN)

( * ) Notice: Subject to any disclaimer, the term of this patent is extended or adjusted under 35 U.S.C. 154(b) by 0 days.

(21) Appl. No.: 16/601,583

(22) Filed: Oct. 15, 2019

(65) Prior Publication Data

US 2021/0071524 A1 Mar. 11, 2021

(30) Foreign Application Priority Data

Sep. 10, 2019 (CN) ..... 201910855277.5

(51) Int. Cl.
*E02D 31/00* (2006.01)
*E02D 31/02* (2006.01)
*E21D 11/00* (2006.01)

(52) U.S. Cl.
CPC ..... *E21D 11/006* (2013.01)

(58) Field of Classification Search
CPC ... E02D 31/004; E02D 31/025; E21D 11/006; E21D 21/008; E21D 21/0026; E21D 21/006; E21D 23/0409; E21D 20/00; E21D 21/00; E04C 5/12; E04C 5/125
USPC ..... 405/259.1–302.7
See application file for complete search history.

(56) References Cited

U.S. PATENT DOCUMENTS 2,398,130 A * 4/1946 Beijl ..... E21D 11/006 405/259.1
3,509,726 A * 5/1970 White ..... E21D 11/006 405/302.2
4,052,860 A * 10/1977 Alterman ..... E21D 11/006 405/259.5
4,247,221 A * 1/1981 Lewer ..... E21D 11/15 405/146
4,456,405 A * 6/1984 Galis ..... E21D 11/006 405/259.1
4,634,318 A * 1/1987 Koumal ..... E21D 11/006 405/259.3
4,917,537 A * 4/1990 Jacobson ..... B09B 1/00 405/129.75
5,096,335 A * 3/1992 Anderson ..... E21D 11/152 405/150.1

(Continued)

*Primary Examiner* — Edwin J Toledo-Duran
(74) *Attorney, Agent, or Firm* — W & KIP

(57) ABSTRACT

The invention relates to the technology of rib spalling. In the present invention, adjacent support anchors are tightly connected with each other by anchor cables; each of the support anchors are at least connected with an anchor cable tightly extending from four different directions, so that each of the anchor cables constitutes a mesh structure, and a flexible gap corresponding to the thickness of the support anchor is formed between the inner flexible support net and the outer support net at the anchor cable, which not only allows the support anchor to tighten an anchor bolt, but also makes the anchor bolt in the entire region form a whole.

10 Claims, 6 Drawing Sheets

(56) References Cited

U.S. PATENT DOCUMENTS

| | | | | | |
|---|---|---|---|---|---|
| 5,277,520 | A * | 1/1994 | Travis | E02D 29/0241 | 405/129.6 |
| 5,462,391 | A * | 10/1995 | Castle | E21D 11/006 | 405/259.1 |
| 5,466,095 | A * | 11/1995 | Scott | E21D 11/006 | 405/259.1 |
| 5,525,013 | A * | 6/1996 | Seegmiller | E21D 11/006 | 405/259.3 |
| 5,596,853 | A * | 1/1997 | Blaney | E04C 2/044 | 52/223.7 |
| 8,696,251 | B2 * | 4/2014 | Potvin | E21D 11/152 | 405/302.7 |
| 2011/0176876 | A1 * | 7/2011 | Scuero | E02D 17/202 | 405/259.1 |
| 2012/0251245 | A1 * | 10/2012 | Spearing | E21D 21/008 | 405/302.2 |
| 2013/0343822 | A1 * | 12/2013 | Swarny | E21D 11/38 | 405/150.2 |
| 2015/0056023 | A1 * | 2/2015 | Pinkley | E21D 21/0086 | 405/302.1 |
| 2018/0313055 | A1 * | 11/2018 | Ames | E02D 31/004 | |
| 2018/0347360 | A1 * | 12/2018 | Lavoie | E21F 17/103 | |

* cited by examiner

CONTROL STRUCTURE FOR RIB SPALLING OF COAL WALL WITH LARGE MINING HEIGHT BASED ON FLEXIBLE REINFORCEMENT AND CONSTRUCTION EQUIPMENT THEREFOR

CROSS-REFERENCE TO RELATED APPLICATIONS

This application claims priority to Chinese Patent Application No. 201910855277.5 with a filing date of Sep. 10, 2019. The content of the aforementioned application, including any intervening amendments thereto, are incorporated herein by reference.

TECHNICAL FIELD

The present invention relates to the technical field of rib spalling, in particular, to a control structure for rib spalling of coal wall with large mining height based on flexible reinforcement and a construction equipment therefor.

BACKGROUND

For works in terms of large mining height, with the increase of coal mining height, the stability of the coal wall will decrease, and correspondingly the probability of rib spalling for the coal wall will increase. During the mining process, the rib spalling and the roof caving of coal wall may occur, which will affect the safe production of work. Therefore, In the case of rib spalling for the coal wall with large mining height, reinforcement has to be made for the rib spalling of the coal wall so as to prevent accidents.

Currently, the combination of the anchor bolt and the anchor cable is generally used for supporting and roof supporting of the roadway. This support method is shown in FIG. 1, wherein an anchor bolt and an anchor cable are used, with the combination of an anchoring slurry, to support the anchoring support net or the support roof and the roadway support board on the wall of the roadway, so as to support the roadway for preventing prevent collapse or coal rock from falling off.

However, at present, this type of roof support is generally carried out with pure rigid support, and after supporting for a period of time, with the continuous mining in the later period, the rock formations on the upper layer, especially the soft rock layers, may easily cause the top support to be unbalanced. This is mainly because even small deformations can cause the supporting force of the region or other areas to rise sharply and the support ability of some parts to be weak due to the damaged balance of the overall force of the rigid support and difficulty for the rigid support to achieve adaptive adjustment once the rock formation at a certain location is loose or slipping. In this case, lightly speaking, there are bumps in some parts, and seriously speaking, there are problems such as breakage of the local support board and even failure of the anchor bolt.

Therefore, those skilled in the art provide a construction equipment for the control structure for rib spalling of coal wall with large mining height based on flexible reinforcement to solve the problems proposed in above background.

SUMMARY

The purpose of the present invention is to provide a construction equipment for the control structure for rib spalling of coal wall with large mining height based on flexible reinforcement to solve the problems proposed in above background.

To this end, the present invention provides the following technical solutions:

A construction equipment for the control of rib spalling of coal wall with large mining height based on flexible reinforcement, comprising an inner flexible support net, a support anchor, an anchor cable and an outer support net, wherein the support anchor is fixed to an outer end of the anchor bolt and pre-tightens the anchor bolt, characterized in that the inner flexible support net is disposed between an inner side of the support anchor and a roadway rock wall to be supported, and an outer side of the support anchor is provided with the outer support net, the outer support net being supported by a support roof, a roadway support board or a solidified anchor slurry layer;

adjacent support anchors are tightly connected with each other by anchor cables; and each support anchor is at least connected with the anchor cable tightly extending from four different directions, so that each anchor cable is configured as a mesh structure; and a flexible gap corresponding to the thickness of the support anchor is formed between the inner flexible support net and the outer support net at the anchor cable.

Further, preferably, each anchor cable directly connected to the support anchor is non-parallel.

Further, preferably, the support anchor includes a pre-tightening head and an anchoring seat, wherein the pre-tightening head is provided with a connecting hole fixedly connected to an outer end of the anchor bolt, the opposite ends of the pre-tightening head are also connected with the anchoring seat, the anchoring seat is provided therein with at least two anchoring holes communicating with each other, and an end of the anchor cable may extend into the anchoring hole to be anchored to the anchoring seat.

Further, preferably, a center of an end of the anchoring seat away from the pre-tightening head, is further provided with an anchoring grouting hole, and the anchoring grouting hole is communicated with the anchoring hole.

Further, preferably, an end of the anchor cable extends into the anchoring hole, and is grouted to be anchored in the anchoring hole by using a grouting anchoring agent.

Further, preferably, a connection between the pre-tightening head and the anchoring seat is further provided with a tapered connecting section, and the tapered connecting section is provided with a tension control nut, so as to achieve internal tightening and locking control of the connecting section by twisting the tension control nut.

Further, preferably, the equipment is used for constructing the control structure for rib spalling of coal wall with large mining height based on flexible reinforcement according to the present invention, so as to extend the end of the anchor cable into the anchoring hole of the support anchor, comprising:

a connecting seat with an end provided with a positioning seat, the positioning seat and the connecting seat are provided with opposite through holes for the anchor cable to pass through;

a feeding mechanism capable of clamping the anchor cable and moving in the direction of the connecting seat, so as to feed the end of the anchor cable into the anchoring hole of the support anchor;

a positioning locking mechanism capable of positioning the connecting seat and locking it for matching on the anchoring seat of the support anchor, so that the through hole on the positioning seat is docked with the anchoring hole on the anchoring seat;

a grouting anchoring mechanism, the grouting anchoring mechanism capable of injecting an anchoring accelerating mixed slurry to the anchoring hole.

Further, preferably, the feeding mechanism includes a feeding cylinder, a guiding sliding seat and a clamping robot, wherein the feeding cylinder is fixed to an inner side of the connecting seat, a piston end of the feeding cylinder is connected to the guiding sliding seat, and the guiding sliding seat is in sliding cooperation with an inner side wall of the connecting seat; the guiding sliding seat is further provided with the clamping robot facing the anchoring cable, and the clamping robot may clamp/release the anchoring cable.

Further, preferably, the positioning locking mechanism includes a locking cylinder and a locking limit grasping head; the locking limit grasping head is of an L-shaped structure, and the locking limit grasping head may be locked and limited to an end corner of the anchoring seat, the locking limit grasping head being connected to an end of the connecting seat by using the locking cylinder; when the connecting seat is connected, locked and positioned on the anchoring seat, the locking cylinder drives the locking limit grasping head to achieve a locking and releasing action.

Further, preferably, the grouting anchoring mechanism includes a grouting pump and a grouting head; the grouting head is located at a central position of the connecting seat, and the anchoring grouting hole on the anchoring seat may be in positioning and sleeving connection with the grouting head.

Compared with the prior art, the present invention has the following beneficial effects:

1. In the present invention, adjacent support anchors are tightly connected with each other by anchor cables; each of the support anchors are at least connected with an anchor cable tightly extending from four different directions, so that each of the anchor cables constitutes a mesh structure, and in this way, a flexible gap corresponding to the thickness of the support anchor is formed between the inner flexible support net and the outer support net at the anchor cable, which not only allows the support anchor to tighten an anchor bolt, but also makes the anchor bolt in the entire region form a whole. If a slip occurs at a certain position, the entire region will increase a pulling force or supporting force for the position where the slip occurs, and with the cooperation of the flexible gap, the local adverse effects of tiny slip on a support roof or the roadway side board can be prevented, and the support ability and uniformity can be improved as well as ensuring the adaptive ability of the support after slipping after a long time of support.

2. In the present invention, the support anchors are at least connected with an anchor cable tightly extending from four different directions, so that the force of the support anchor may be more uniform and stable, and hence the stability of the support is improved;

3. The present invention further provides a construction equipment for constructing the control structure for rib spalling of coal wall with large mining height based on flexible reinforcement, so as to extend the end of the anchor cable into the anchoring hole of the support anchor. The construction equipment may automatically anchor, fix and connect the anchor cables, improving the convenience and reliability of the construction, ensuring the reinforcement ability for the rib spalling of coal wall with large mining height.

DETAILED DESCRIPTION

Figure 1:
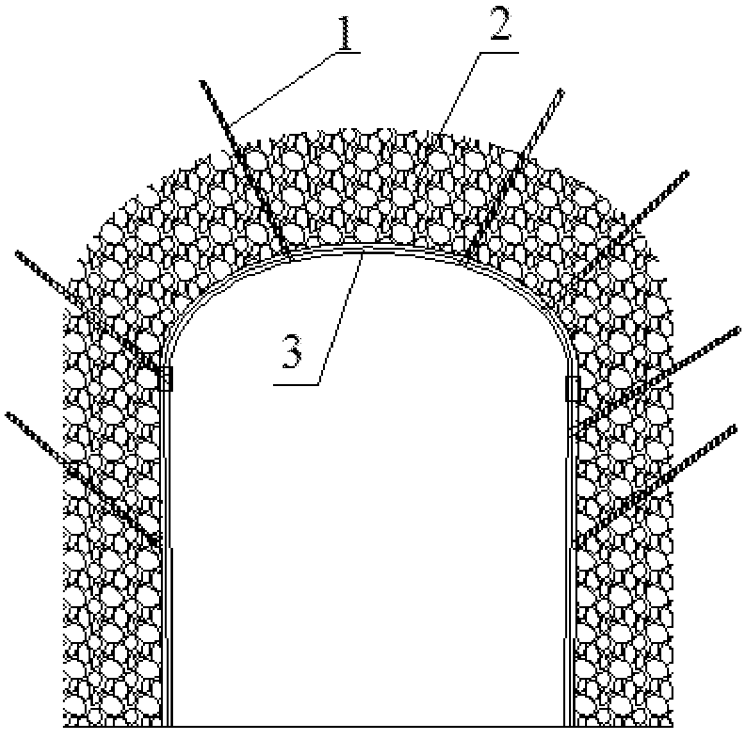
FIG. 1 is a structural view of the support for the rib spalling of coal wall with large mining height in the prior art.
Figure 2:
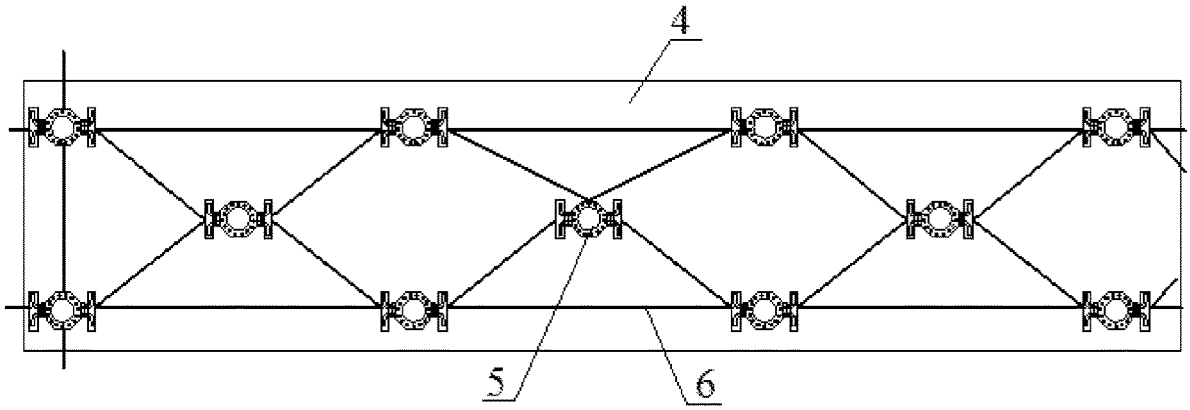
FIG. 2 is a view of the unfolding structure of the connection arrangement of a support anchor and the anchor cable in the control structure for rib spalling of coal wall with large mining height based on flexible reinforcement of the present invention.
Figure 3:
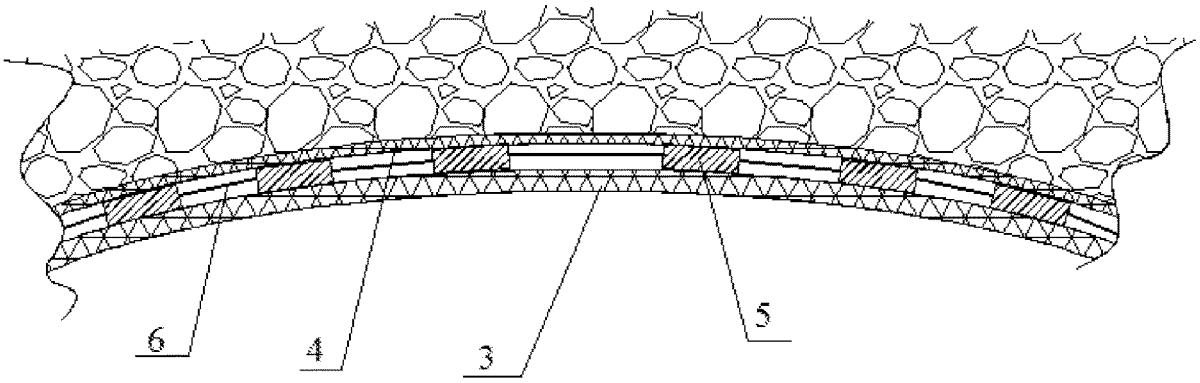
FIG. 3 is a local structural view of the roof of a control structure for rib spalling of coal wall with large mining height based on flexible reinforcement.
Figure 4:
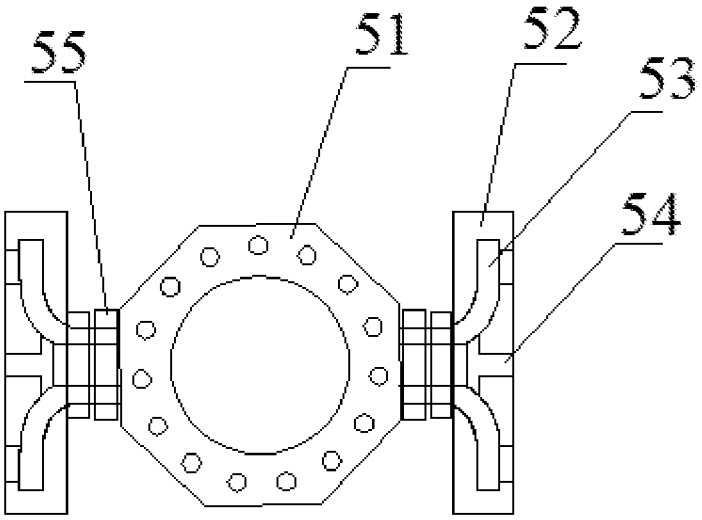
FIG. 4 is a structural view of the support anchor of the control structure for rib spalling of coal wall with large mining height based on flexible reinforcement.
Figure 5:
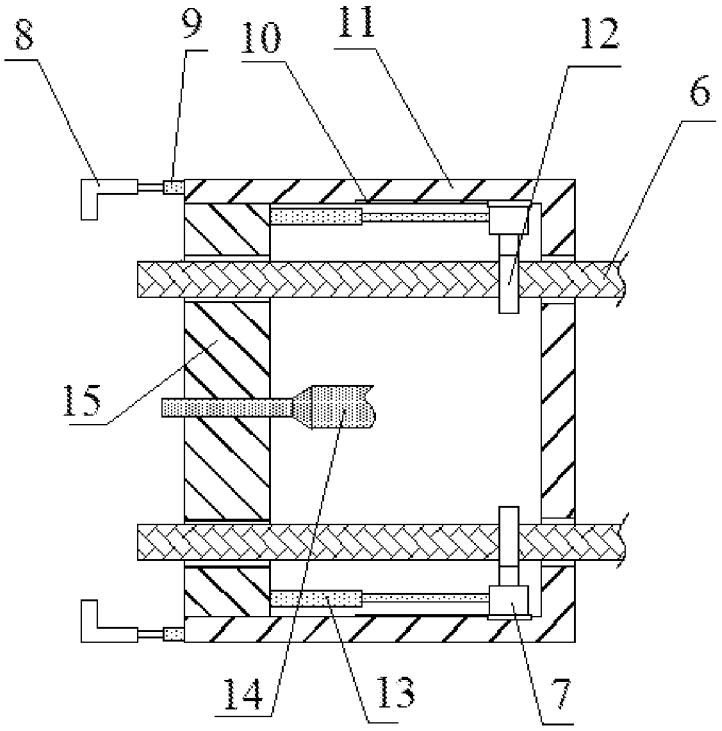
FIG. 5 is a structural view of a construction equipment for the control of rib spalling of coal wall with large mining height based on flexible reinforcement.
Figure 6:
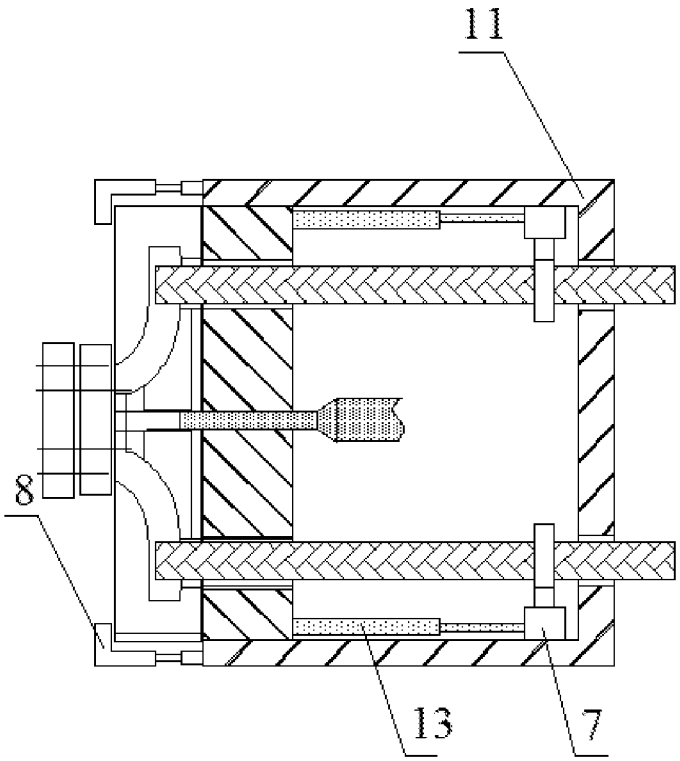
FIG. 6 is a structural view of a construction equipment for the control of rib spalling of coal wall with large mining height based on flexible reinforcement under construction.

With reference to FIGS. 1 to 6, in an embodiment of the present invention, a construction equipment for the control of rib spalling of coal wall with large mining height based on flexible reinforcement comprises an inner flexible support net 4, a support anchor 5, an anchor cable 6 and an outer support net 3, wherein the support anchor 5 is fixed to an outer end of the anchor bolt 1 and pre-tightens the anchor bolt 1, characterized in that the inner flexible support net 4 is disposed between an inner side of the support anchor and a roadway rock wall 2 to be supported, and an outer side of the support anchor 5 is provided with the outer support net 3, the outer support net 3 being supported by a support roof, a roadway support board or a solidified anchor slurry layer; adjacent support anchors 5 are tightly connected with each other by anchor cables 6; and each support anchor 5 is at least connected with the anchor cable 6 tightly extending from four different directions, so that each anchor cable 6 is configured as a mesh structure; and a flexible gap corresponding to the thickness of the support anchor is formed between the inner flexible support net and the outer support net at the anchor cable.

In the present embodiment, each anchor cable 6 directly connected to the support anchor 5 is non-parallel.

As a preferred embodiment, the support anchor 5 includes a pre-tightening head 51 and an anchoring seat 52, wherein the pre-tightening head 51 is provided with a connecting hole fixedly connected to an outer end of the anchor bolt, the opposite ends of the pre-tightening head are also connected with the anchoring seat 52, the anchoring seat 52 is provided therein with at least two anchoring holes 53 communicating with each other, and an end of the anchor cable 6 may extend into the anchoring hole to be anchored to the anchoring seat 52.

Among them, a center of an end of the anchoring seat 52 away from the pre-tightening head, is further provided with an anchoring grouting hole 54, and the anchoring grouting hole is communicated with the anchoring hole 53. An end of the anchor cable 6 extends into the anchoring hole, and is grouted to be anchored in the anchoring hole by using a grouting anchoring agent.

A connection between the pre-tightening head 51 and the anchoring seat 52 is further provided with a tapered connecting section, and the tapered connecting section is provided with a tension control nut 55, so as to achieve internal tightening and locking control of the connecting section by twisting the tension control nut 55.

Further, the present invention provides a construction equipment for the control structure for rib spalling of coal wall with large mining height based on flexible reinforcement, characterized in that the equipment is used for constructing the control structure for rib spalling of coal wall with large mining height based on flexible reinforcement of the present invention, so as to extend the end of the anchor cable 6 into the anchoring hole of the support anchor 5, comprising:

a connecting seat 11 with an end provided with a positioning seat 15, the positioning seat and the connecting seat are provided with opposite through holes for the anchor cable 6 to pass through;

a feeding mechanism capable of clamping the anchor cable 6 and moving in the direction of the connecting seat, so as to feed the end of the anchor cable 6 into the anchoring hole of the support anchor 5;

a positioning locking mechanism capable of positioning the connecting seat and locking it for matching on the anchoring seat 52 of the support anchor 5, so that the through hole on the positioning seat is docked with the anchoring hole on the anchoring seat 52;

a grouting anchoring mechanism 14, the grouting anchoring mechanism 14 capable of injecting an anchoring accelerating mixed slurry to the anchoring hole.

Among them, the feeding mechanism includes a feeding cylinder 13, a guiding sliding seat 7 and a clamping robot 12, wherein the feeding cylinder 13 is fixed to an inner side of the connecting seat, a piston end of the feeding cylinder is connected to the guiding sliding seat, and the guiding sliding seat 7 is in sliding cooperation with an inner side wall of the connecting seat; the guiding sliding seat is further provided with the clamping robot 12 facing the anchoring cable, and the clamping robot may clamp/release the anchoring cable.

The positioning locking mechanism includes a locking cylinder 9 and a locking limit grasping head 8; the locking limit grasping head is of an L-shaped structure, and the locking limit grasping head may be locked and limited to an end corner of the anchoring seat 52, the locking limit grasping head 8 being connected to an end of the connecting seat by using the locking cylinder; when the connecting seat is connected, locked and positioned on the anchoring seat, the locking cylinder 9 drives the locking limit grasping head 8 to achieve a locking and releasing action.

The grouting anchoring mechanism 14 includes a grouting pump and a grouting head; the grouting head is located at a central position of the connecting seat, and the anchoring grouting hole 54 on the anchoring seat may be in positioning and sleeving connection with the grouting head.

In the present invention, adjacent support anchors are tightly connected with each other by anchor cables; each of the support anchors are at least connected with an anchor cable tightly extending from four different directions, so that each of the anchor cables constitutes a mesh structure, and in this way, a flexible gap corresponding to the thickness of the support anchor is formed between the inner flexible support net and the outer support net at the anchor cable, which not only allows the support anchor to tighten an anchor bolt, but also makes the anchor bolt in the entire region form a whole. If a slip occurs at a certain position, the entire region will increase a pulling force or supporting force for the position where the slip occurs, and with the cooperation of the flexible gap, the local adverse effects of tiny slip on a support roof or the roadway side board can be prevented, and the support ability and uniformity can be improved as well as ensuring the adaptive ability of the support after slipping after a long time of support. In the present invention, the support anchors are at least connected with an anchor cable tightly extending from four different directions, so that the force of the support anchor may be more uniform and stable, and hence the stability of the support is improved; the present invention further provides a construction equipment for constructing the control structure for rib spalling of coal wall with large mining height based on flexible reinforcement, so as to extend the end of the anchor cable into the anchoring hole of the support anchor. The construction equipment may automatically anchor, fix and connect the anchor cables, improving the convenience and reliability of the construction, ensuring the reinforcement ability for the rib spalling of coal wall with large mining height.

What is mentioned above is only the specific implementation of the present invention, but does not limit the protection scope of the present invention. All the equivalents or modifications made by anyone skilled in the art in accordance with the technical solutions of the present invention and the inventive concept thereof within the technical scope of the present disclosure are intended to be included within the scope of the present invention.

We claim:

1. A control structure for supporting a coal mine tunnel wall (2), comprising an inner flexible support net (4), a support anchor (5), an anchor cable (6) and an outer support net (3), wherein the support anchor (5) is fixed to an outer end of the anchor bolt (1) and pre-tightens the anchor bolt (1), characterized in that the inner flexible support net (4) is disposed between an inner side of the support anchor and the coal mine tunnel wall (2), and an outer side of the support anchor (5) is provided with the outer support net (3), the outer support net (3) being supported by a mechanism selected from the group consisting of a support roof, a tunnel support board and an anchored slurry layer;

adjacent support anchors (5) are tightly connected with each other by anchor cables (6); and each support anchor (5) is at least connected with the anchor cable (6) tightly extending from four different directions, so that each anchor cable (6) is configured as a mesh structure;

and a flexible gap corresponding to the thickness of the support anchor is formed between the inner flexible support net and the outer support net at the anchor cable;

wherein the anchor bolt is bolted in the coal mine tunnel wall.

2. The control structure for supporting a coal mine tunnel wall (2) according to claim 1, characterized in that each anchor cable (6) directly connected to the support anchor (5) is non-parallel.

3. The control structure for supporting a coal mine tunnel wall (2) according to claim 1, characterized in that the support anchor (5) includes a pre-tightening head (51) and an anchoring seat (52), wherein the pre-tightening head (51) is provided with a connecting hole fixedly connected to an outer end of the anchor bolt, the opposite ends of the pre-tightening head are also connected with the anchoring seat (52), the anchoring seat (52) is provided therein with at least two anchoring holes (53) communicating with each other, and an end of the anchor cable (6) may extend into the anchoring hole to be anchored to the anchoring seat (52).

4. The control structure for supporting a coal mine tunnel wall (2) according to claim 3, characterized in that a center of an end of the anchoring seat (52) away from the pre-tightening head, is further provided with an anchoring grouting hole (54), and the anchoring grouting hole is communicated with the anchoring hole (53).

5. The control structure for supporting a coal mine tunnel wall (2) according to claim 4, characterized in that an end of the anchor cable (6) extends into the anchoring hole, and is grouted to be anchored in the anchoring hole by using a grouting anchoring agent.

6. The control structure for supporting a coal mine tunnel wall (2) according to claim 4, characterized in that a connection between the pre-tightening head (51) and the anchoring seat (52) is further provided with a tapered connecting section, and the tapered connecting section is provided with a tension control nut (55), so as to achieve internal tightening and locking control of the connecting section by twisting the tension control nut (55).

7. A construction equipment for the control structure for supporting a coal mine tunnel wall (2), characterized in that the equipment is used for constructing the control structure for supporting a coal mine tunnel wall (2) according claim 1, so as to extend the end of the anchor cable (6) into the anchoring hole of the support anchor (5), comprising:

a connecting seat (11) with an end provided with a positioning seat (15), the positioning seat and the connecting seat are provided with opposite through holes for the anchor cable (6) to pass through;

a feeding mechanism capable of clamping the anchor cable (6) and moving in the direction of the connecting seat, so as to feed the end of the anchor cable (6) into the anchoring hole of the support anchor (5);

a positioning locking mechanism capable of positioning the connecting seat and locking it for matching on the anchoring seat (52) of the support anchor (5), so that the through hole on the positioning seat is docked with the anchoring hole on the anchoring seat (52);

a grouting anchoring mechanism (14), the grouting anchoring mechanism (14) capable of injecting an anchoring accelerating mixed slurry to the anchoring hole.

8. The construction equipment for the control structure for supporting a coal mine tunnel wall (2) according to claim 7, characterized in that the feeding mechanism includes a feeding cylinder (13), a guiding sliding seat (7) and a clamping robot (12), wherein the feeding cylinder (13) is fixed to an inner side of the connecting seat, a piston end of the feeding cylinder is connected to the guiding sliding seat, and the guiding sliding seat (7) is in sliding cooperation with an inner side wall of the connecting seat; the guiding sliding seat is further provided with the clamping robot (12) facing the anchoring cable, and the clamping robot may clamp/release the anchoring cable.

9. The construction equipment for the control structure for supporting a coal mine tunnel wall (2) according to claim 7, characterized in that the positioning locking mechanism includes a locking cylinder (9) and a locking limit grasping head (8); the locking limit grasping head is of an L-shaped structure, and the locking limit grasping head may be locked and limited to an end corner of the anchoring seat (52), the locking limit grasping head (8) being connected to an end of the connecting seat by using the locking cylinder; when the connecting seat is connected, locked and positioned on the anchoring seat, the locking cylinder (9) drives the locking limit grasping head (8) to achieve a locking and releasing action.

10. The construction equipment for the control structure for supporting a coal mine tunnel wall (2) according to claim 7, characterized in that the grouting anchoring mechanism (14) includes a grouting pump and a grouting head; the grouting head is located at a central position of the connecting seat, and the anchoring grouting hole (54) on the anchoring seat may be in positioning and sleeving connection with the grouting head.

* * * * *